United States Patent [19]

Boyles

[11] Patent Number: 4,921,069

[45] Date of Patent: May 1, 1990

[54] CLIMBING DEVICE

[76] Inventor: Ralph D. Boyles, 156 Grove Dr., Cortland, Ohio 44410

[21] Appl. No.: 329,687

[22] Filed: Mar. 28, 1989

[51] Int. Cl.[5] ..... A63B 27/00

[52] U.S. Cl. ..... 182/135; 182/7; 182/136

[58] Field of Search ..... 182/133, 134, 135, 136, 182/7; 188/65.1, 65.2

[56] References Cited

U.S. PATENT DOCUMENTS

| | | | |
|---|---|---|---|
| 187,569 | 2/1877 | Tixier | 182/7 |
| 315,025 | 4/1885 | Heath | 182/135 |
| 376,622 | 1/1888 | Abbott . | |
| 983,335 | 2/1911 | Westad | 182/135 |
| 1,117,800 | 11/1914 | Davidson | 182/136 |
| 1,229,394 | 6/1917 | Abramson . | |
| 1,826,263 | 10/1931 | Stephens . | |
| 2,070,580 | 2/1937 | Cochran | 182/7 |
| 3,484,833 | 12/1969 | Stephen | 182/7 |
| 3,938,620 | 2/1976 | Nothiger | 182/135 |
| 4,034,828 | 7/1977 | Rose et al. . | |
| 4,077,094 | 3/1978 | Swager . | |
| 4,253,218 | 3/1981 | Gibbs . | |
| 4,588,046 | 5/1986 | van der Neer et al. . | |
| 4,595,076 | 6/1986 | Gober | 182/136 |
| 4,830,143 | 5/1989 | Fisher | 182/135 |

*Primary Examiner*—Reinaldo P. Machado
*Attorney, Agent, or Firm*—D. Peter Hochberg; Mark Kusner; Louis J. Weisz

[57] ABSTRACT

A tree climbing device which includes a rope clamp that can be locked to a rope having a tree trunk-encircling loop, and which is connected to a user harness so that a climber can be suspended from the tree trunk by the device during the climbing process. The clamp comprises rope-gripping member with adjacent opposing ends spaced from each other, that together with link plates pivotally attached to the members on either side thereof define a space through which the rope is passed. The end of each of the members opposite the space is pivotally attached to one end of different support legs, the other end of the legs being attached to a support bar. Spring means are provided which urge the support bar from one of the link plates, reducing the space, and locking the rope therein. When pressure is applied opposite to such urging, the space is increased, unlocking the device so that the rope can be moved through the clamp for rope adjustment purposes required to facilitate the climbing process.

8 Claims, 4 Drawing Sheets

CLIMBING DEVICE

TECHNICAL FIELD

This invention relates to a device useful for assisting climbers. More particularly, this invention relates to a device which permits a user to climb trees and poles while wearing a safety harness. Specifically, this invention relates to an adjustable rope-clamping device that can be attached to a tree or pole, and simultaneously to a safety harness fastened to a climber, which supports the climber while changes are made in the elevation of an associated support, and which can be adjusted to accommodate changes required by the process of climbing.

BACKGROUND OF THE INVENTION

From time-to-time, various individuals have a need to ascend and descend columnar structures such as telephone poles, trees, and the like. Linemen, for example, are frequently required to do so in the course of their job of repairing and installing equipment on poles carrying power or telephone lines, or associated equipment.

Sportsmen, especially deer hunters, make up another group that frequently wish to climb such structures. Deer hunters oftentimes stand and wait for their quarry, as opposed to stalking it, and many of the hunters who use the "stand" approach to hunting, frequently those who hunt with bow and arrow, prefer to locate a supporting platform, or stand, in the top of a tree, preferably in the vicinity of a trail or other area known to be frequented by deer. Besides providing a wide range of vision and a clearer field of view to the hunter, deer are unaccustomed to viewing the tops of trees for possible sources of danger; consequently, a hunter located therein is oftentimes able to enjoy closer shooting opportunities than might otherwise be possible.

While hunting from trees provides the advantages described, it also has the disadvantage of requiring the hunter to climb to the top of a tree of choice, frequently an arduous and potentially hazardous activity. These difficulties have long been recognized, and a number of devices have been proposed to eliminate them. Among such devices, for example, is a bendable, semicircular device with handles projecting from the two ends thereof. The device is fitted with inwardly projecting spikes which can be positioned about a tree and thrust inwardly, temporarily fastening the device to the tree, thus providing a handhold for the climber while his legs, which are pressed about the tree, are repositioned upwardly while climbing, or downwardly during the process of descent. Although effective, the device entails considerable physical effort, and is relatively dangerous since the climber is not securely fastened to the tree.

Another device for climbing involves the use of a rectangularly shaped frame-like structure which can be assembled loosely about the tree to be climbed. When angled downwardly from the horizontal, the device provides sufficient friction or "purchase" against the tree to support a climber holding onto the lower end of the structure, again allowing repositioning of the climber's legs about the tree. As in the case of the first-described device, the latter device also exposes a user to danger, since he is not fastened to the tree, and as in the case of the previous device, its use is physically demanding.

A variety of other climbing devices, and safety harnesses associated therewith, have also been proposed, but they are frequently complicated, difficult to use, or suffer from other disadvantages.

DISCLOSURE OF THE INVENTION

In view of the preceding, therefore, it is a first aspect of this invention to provide a climbing device which is safer to use.

A second aspect of this invention is to provide a climbing device which reduces the physical exertion involved in climbing poles, trees, and other columnar structures.

Another aspect of this invention is the provision of a pole and tree climbing device which is simple in design, and easy to use.

A further aspect of this invention is to furnish a tree-climbing device which is compact and lightweight, facilitating its use by hunters.

An additional aspect of this invention is to provide a climbing device that is durable and relatively inexpensive.

The preceding and other aspects of the invention are provided by a rope clamp for resisting slippage of a rope therethrough when the clamp is in its locked mode, while allowing slippage when the clamp is in its unlocked mode comprising: two rope-gripping members; two link plates; two support legs; a base bar, and spring means, wherein a first end of each of said members is pivotally attached to a different end of said link plates, one of said link plates being positioned on each side of said members, said first ends being spaced from each other to provide a space defined by said first ends and by said link plates, adapted to receive a rope therein, the other end of each of said members being pivotally connected to an end of one of said support legs, the other end of each of said legs being pivotally connected to said base bar, and wherein said spring means are positioned between said base bar and one of said link plates so as to urge said one of said link plates from said base bar, pivoting said members and thereby reducing said space at a point of minimum spacing between said first ends and, therefore, increasing the frictional engagement between said first ends and a rope positioned therebetween, placing the clamp in its locked mode, and wherein when said spring means is forced against such urging, said members are also pivoted, whereby said spacing at said point of minimum spacing is maximized, reducing said frictional engagement, and placing the clamp in its unlocked mode.

The preceding and further aspects of the invention are provided by a column climbing device comprising in combination: the rope clamp of claim 1; a user harness; and a rope with an adjustable loop on one end thereof, said harness being attached to said rope clamp, and said rope being positioned between said rope-gripping members.

The preceding and yet additional aspects of the invention are furnished by a tree-climbing device comprising a rope with an adjustable loop on one end thereof; a rope clamp; and a user harness, said clamp comprising two rope-gripping members, two link plates, two support legs, a base bar, and spring means, a first end of each of said members being pivotally attached to a different end of said link plates, one of said link plates being positioned on each side of said members, said first ends being spaced from each other to provide a space defined by said first ends and said link plates, adapted to receive a rope therein, the other end of each of said members being pivotally connected to an end of one of said support legs, the other end of each of said legs being pivotally connected to said base bar, said spring means being positioned between said space bar and one of said link plates so as to urge said one of said link plates from said base bar, pivoting said members and thereby reducing said space at a point of minimum spacing between said first ends, locking the clamp so as to resist movement of a rope therethrough, and when said one of said link plates is forced against said urging, said rope-gripping members are also pivoted, whereby said spacing at said point of minimum spacing is maximized and the clamp is unlocked, facilitating said movement, wherein said rope is positioned between said first ends of said rope-gripping members, and said user harness is connected to said clamp so that a user of the device wearing said harness can be securely suspended from a tree encircled by said loop when said clamp is locked.

BRIEF DESCRIPTION OF THE DRAWINGS

The invention will be better understood when reference is had to the following Figures, in which like-numbers refer to like-parts, and in which.

DETAILED DESCRIPTION OF THE INVENTION

Figure 1:
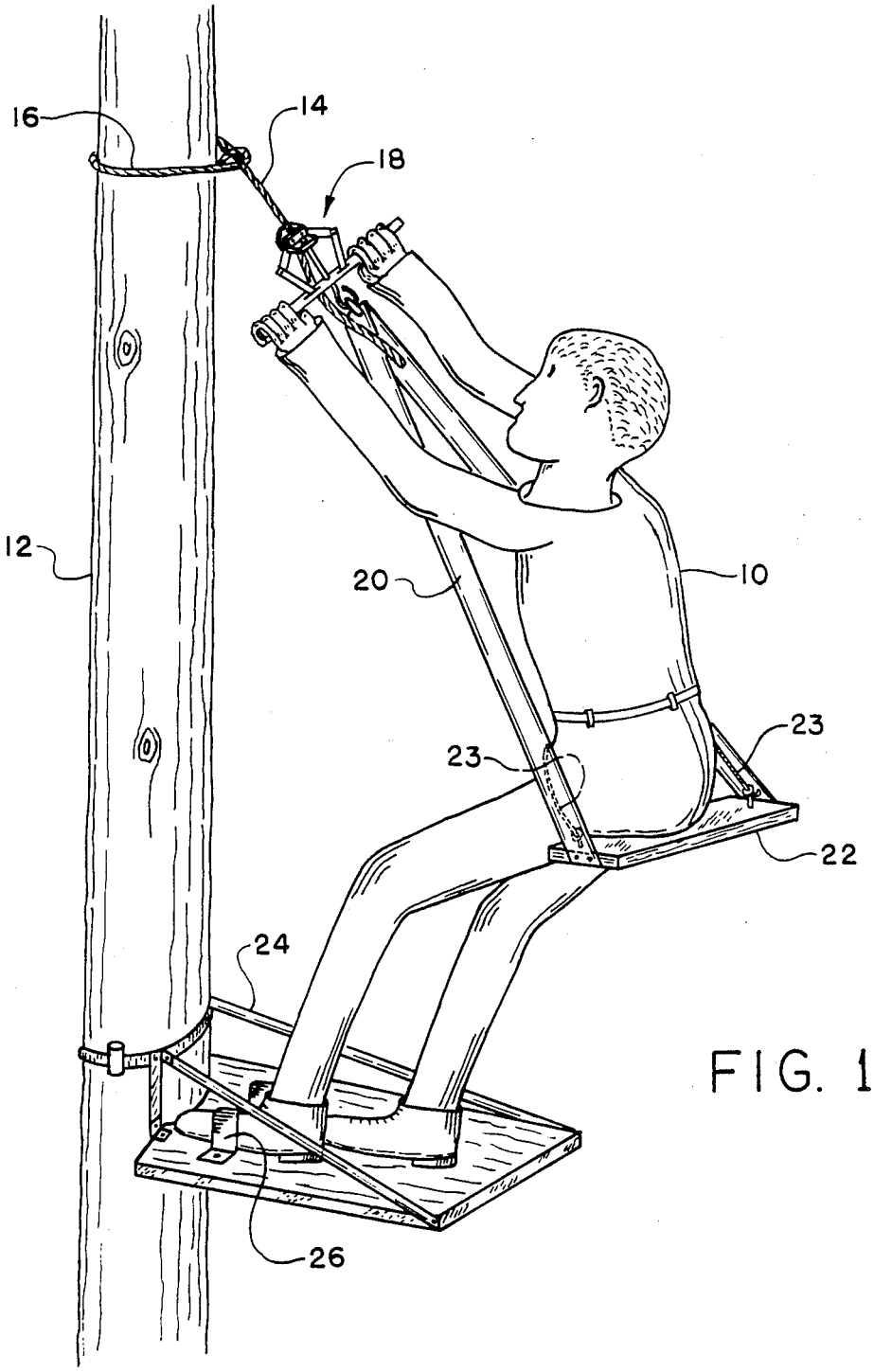
FIG. 1 is an isometric view of a tree climber using the device of the invention.

FIG. 1 is an isometric view of a tree climber using the device of the invention. As illustrated in the Figure, a tree climber 10 is using a clamp device of the invention, generally 18, an associated rope 14, and a harness assembly to climb a tree 12. As shown, the harness assembly consists of a sling 20, fastened to a seat member 22 which has an elastic strap 23, sometimes referred to as a "banji strap", attached thereto. The Figure also shows a tree stand, generally 24, an associated support involved in the climbing process.

The process of climbing is accomplished by initially fastening the tree stand 24 about the base of the tree 12. The loop-end 16 of rope 14 is thereafter passed about the tree, and the free end of the rope is threaded through the clamp 18, as will be more particularly described hereinafter. The sling 20 of the harness member encircling the climber is then connected to the clamp, and the climber raises the loop as far as possible on the tree.

The banji strap is fastened to the seat member 22 across the lap of the climber by means of hooks located at the ends of the strap that engage each side of the seat, usually by means of eyebolts installed therein. Use of a banji strap provides an additional measure of safety and is a preferred embodiment of the invention since it secures the seat to the climber in its position of use, allowing the seat to remain in place across the buttocks of the climber when the sling 20 becomes slack during the climbing process.

Following the preliminary positioning of the components as described, the climber suspends himself by grasping the handle extensions on the clamp and leaning back in the seat 22 of the harness assembly. The climber then inserts the toes of his shoe into footstraps 26, or their equivalent, and bends his knees so that the tree stand 24, which fits loosely about tree trunk 12, is raised upwardly along the trunk. The climber thereafter supports his weight on the raised tree stand and either unlocks the clamp 18, so that it can be slipped along the rope and raised closer to loop 16 and relocked, or raises the loop 16 on the trunk of the tree. Both adjustments can be made if appropriate. Thereupon, the climber again places his weight on the seat 22, after which he adjusts the tree stand 24 upwardly with his feet, as in the previous cycle. The loop and/or clamp are again adjusted and the process is repeated. By continuing the adjustment cycle, the climber gradually ascends the tree to the point desired. The process of descent is exactly opposite to the climbing process. Specifically, while the climber rests his weight on the seat 22, he uses his feet by inserting them in straps 26, or some other part of the structure of the tree stand 24, lowering it as far as possible. Next, while standing on the repositioned tree stand, the loop 16 is moved downward on the trunk, or the clamp 18 is unlocked and moved further away from the loop and relocked, or both adjustments are performed. This allows the climber to again reposition the tree stand 24, the cycle being repeated until the climber reaches the ground.

While the harness shown comprises a sling 20 with associated seat 22, other forms of harness can also be employed, as for instance, a safety belt or other form of body strapping can be fastened about the climber, and attached by suitable means to the clamp 18.

In addition, while the climbing process is described in connection with the Figure relies upon the use of the tree stand 24, other associated support means could also be used such as linemen's climbers, other fastening devices, or even simply pressure exerted by the legs of the climber against the trunk of the tree.

Figure 2:
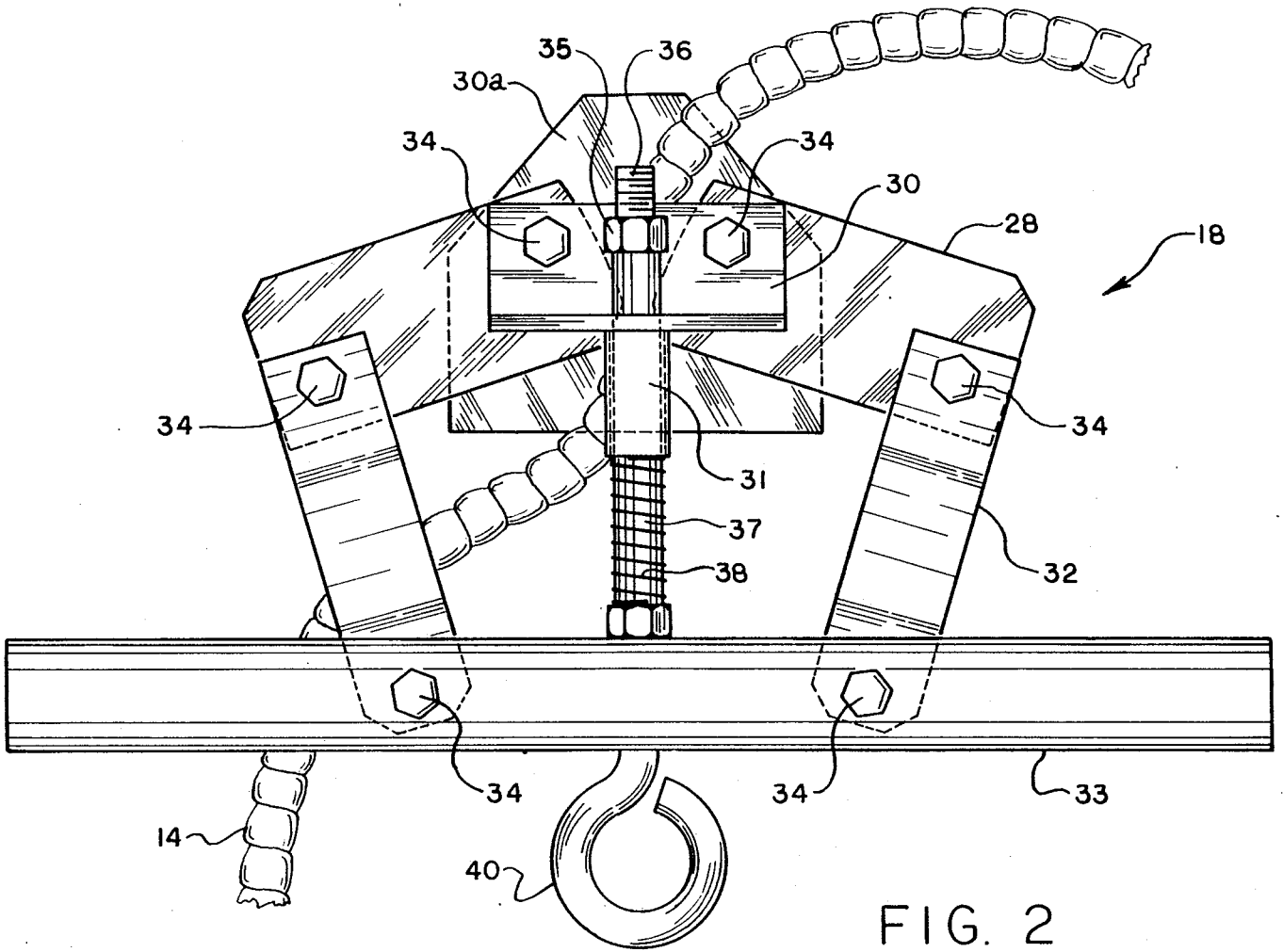
FIG. 2 is an elevation of the clamp of the invention with a rope positioned therein.

FIG. 2 is an elevation of the clamp of the invention with a rope positioned therein.

As shown in the Figure, the ends of rope-gripping members 28 are positioned opposite and substantially adjacent to each other, with link plates 30 and 30*a* located on both sides thereof, being pivotally fastened to the rope-gripping members at pivot points 34.

The rope-gripping members 28 are spaced from each other so that the members, together with the link plates, define a space through which rope 14 passes.

Each of the other ends of the rope-gripping members is pivotally attached to gripping-member support legs 32. The other ends of the support legs are pivotally connected to a base bar 33 at pivot points 34. One of the link plates, 30, is connected the base bar 33 by means of a pin 36, which is fastened securely to the base bar, but which is slidably fastened to link plate 30, i.e., link plate 30 can slide up and down on the pin, but is prevented from becoming detached therefrom by stop means 35, in the case of the Figure, a nut. Also shown is a spring 38 which urges against guide collar 31 attached to link plate 30, urging the link plate away from the base bar 33. Although not essential, pin 36 may be enclosed in tube 37 to facilitate movement of the link plate and spring during the sliding process. An attachment ring 40 is also secured to the base bar 33.

The dimensions of the clamp components may be varied within fairly broad ranges, depending upon the use to which the clamp is to be put, and the size of the rope which it is intended to engage. In the case of tree climbers, it is desirable that the size and weight of the clamp be such as to be compatible both with convenience of use and safety. In the case of a clamp for tree climbing, the rope-gripping members will typically be from three to four inches long, and approximately one-half inch in thickness. Their width will be governed by strength considerations, as well as by the shape desired for the rope-engaging ends thereof, such considerations being within the capability of those skilled in the art.

The support legs 32 commonly will also be from about 3 to 4 inches long and about $\frac{3}{8}$ inches thick, with a width appropriate for the strength required, and for locating pivot points therein.

The base bar 33 will conveniently be about 12 to 14 inches long, with the extensions for the hands of the user extending about four to five inches on either side of the point of joinder of the support legs and the base bar. In the case of component dimensions as described, the space between the pivot points located on the space bar 33 may be in the order of about $3\frac{1}{2}$–$4\frac{1}{2}$ inches. With respect to the link plates, their points of pivotal attachment may also be varied, but frequently will be located about $1\frac{1}{2}$ to 2 inches from each other. As shown in FIG. 2, the shape of the link plates 30 and 30*a* need not be identical. In general, the length of the link plates will be from about 2 to 3 inches, and at least one of them will be adapted for connection to a spring means, such as that illustrated, comprising pin 36 and spring 38.

The spring means provided for urging the base bar and link plate apart may take different forms, including versions other than that shown in the Figure, since its primary purpose is to urge link plate 30 apart from the base plate. In the spring means assembly illustrated, the spring will typically be from about 1 to 3 inches long, depending on the length of guide collar 31, when one is provided. The guide collar, although not essential, serves to help orient movement of the guide plate along pin 36, and its usage is, therefore, preferred. The pin 36 about which the spring 38 is positioned will normally be about $\frac{1}{4}$ inch in diameter, the diameter of the spring being slightly larger so that it is free to move on the pin; however, a pin of different size may also be employed. With dimensions as described, movement of the spring, and therefore, of the link plate 30 will be about $\frac{1}{2}$ to 1 inch.

Ring 40 allows harness 20 to be connected thereto, as previously described, a function which is accommodated by a ring having a diameter in the order of about 1 inch, sufficiently heavy to support the load of anticipated users.

The pivot points illustrated in FIG. 2 comprise holes drilled in the components to be pivoted, through which bolts are inserted. Other connecting means may also be used, however, such as for example, pins, rivets, or other fasteners passing through appropriate holes.

Figure 3:
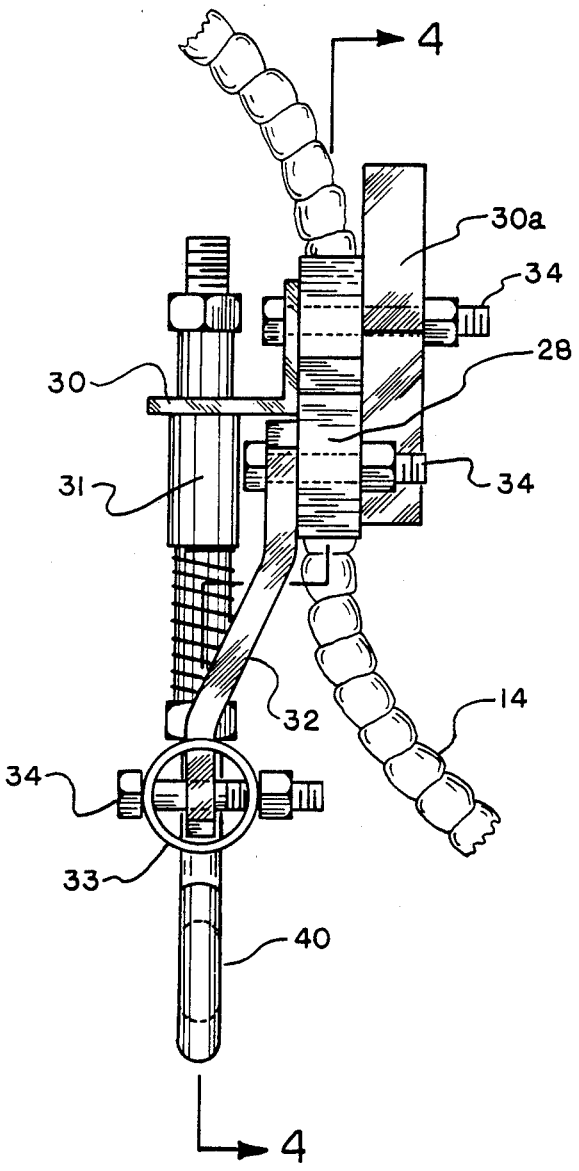
FIG. 3 is an end view of the clamp of FIG. 2.

FIG. 3 is an end view of the clamp of FIG. 2 in which are shown rope-gripping members 28, pivotally fastened to link plates 30*a* on one side, and 30 on the other. The gripping-member support legs 32 are also pivotally connected to the rope-gripping members, and to base bar 33. As illustrated, the support legs are advantageously offset by about 1 to 2 inches to accommodate the spring assembly structure comprising pin 36, which connects link plate 30 with base bar 33, together with spring 38 positioned about the pin so as to urge against guide collar 31 of the link plate. The bolts of pivot points 34 are also shown, as is attachment ring 40.

Base bar 33 may be formed from pipe or tubing, or it may be fashioned in some other suitable shape. However, a circular hollow member is preferred, since it combines strength with light weight. When the base bar is a hollow, circular structure, its diameter will ordinarily be from about $\frac{7}{8}$ to $1\frac{1}{4}$ inches. Link plate 30 is illustrated in FIG. 3 as an "L-shaped" plate; however, other configurations are possible as long as the shape is capable of accommodating the attachment of the spring assembly shown, or other spring means, which in the Figure are attached to the link plate by a hole in the horizontal flange portion of the link plate.

Figure 4:
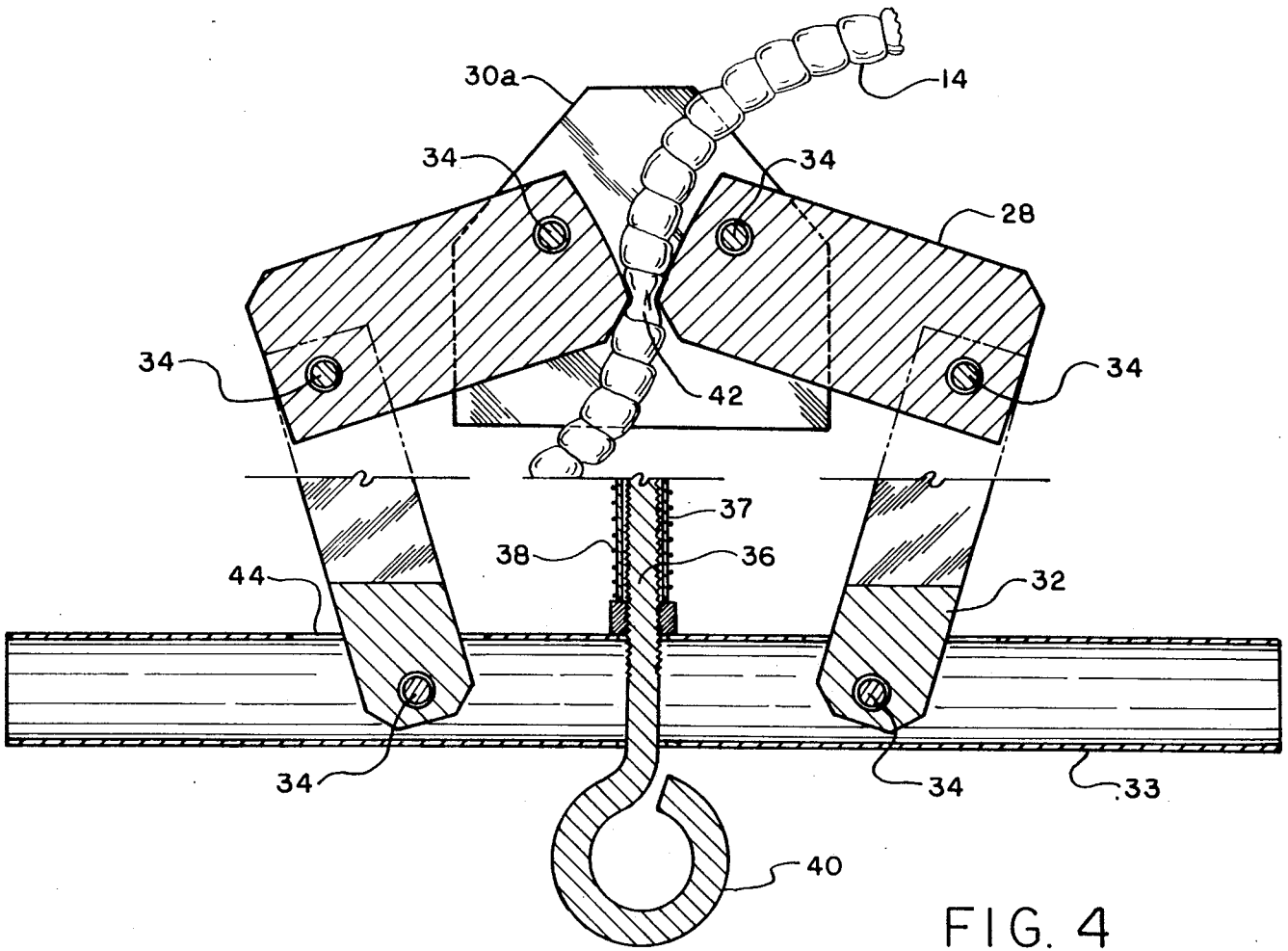
FIG. 4 is a cross-sectioned view of the clamp as shown in FIG. 2, along line 4—4 of FIG. 3.

FIG. 4 is a cross-sectioned view of the clamp as shown in FIG. 2, along line 4—4 of FIG. 3. The Figure shows more clearly the gripping action provided by the rope-gripping members 28 when a rope 14 is passed through the space defined by the ends of the spaced gripping members, and link plates 30*a* and 30 positioned on each side thereof. In its locked mode, the action of spring 38 results in the pivoting upward of rope-gripping members 28 so that the point of minimum spacing 42 between the ends of the members is reduced, becoming insufficient to accommodate an uncompressed rope passing therebetween, and resulting in the frictional engagement of the members ends with a compressed rope, which prevents slippage of the rope through the clamp. As can be visualized, when pressure is exerted against the urging of the spring, for example, by pressing against the link plates and/or the gripping members, the members again pivot about pivot points 34 associated with the link plate end of the members, resulting in maximizing the space at the point of minimum spacing to a degree sufficient to provide a space capable of accommodating an uncompressed rope, and allowing the rope to be movably adjusted between the link plate ends of the rope-gripping members. When the clamp is employed in connection with ropes ordinarily used for climbing trees, i.e., about $\frac{3}{8}$ to $\frac{3}{4}$ inch in diameter, the rope-gripping members will generally be from about $\frac{3}{8}$ to $\frac{5}{8}$ inch apart at the point of minimum spacing 42 when the members are in the unlocked clamp position, the position in which spacing between the ends of the members is maximized.

As the rope-gripping members pivot about the link plate pivot points, they also force a pivoting movement at the point of attachment of the gripping-members with the support legs 32, as well as at the point of attachment between the legs and base bar 33. Pivot slots 44 in the base bar 33 are provided to accommodate the pivoting motion of the support legs. The size of such slots will depend upon the size of the support legs inserted therein, and the degree of movement which they must accommodate. Within such considerations, and with respect to components dimensioned as described in the preceding, it has been found that slots about $1\frac{1}{4}$ to $1\frac{1}{2}$ inches long, and about $\frac{1}{4}$ inch wide, will satisfactorily accommodate the pivoting action.

In its locked position, it can be seen that the clamp generally defines a pentagonal shape, while its shape is generally trapezoidal when it is in its unlocked configuration.

As shown in the Figure, the rope-gripping, or link plate ends of the gripping members are shown as angular at the point of minimum spacing, a preferred mode, since it assures good frictional engagement of the ends with the rope in the clamp-locking mode. If desired, however, such ends may be provided with a different shape, for example, rounded, or others.

Various metals may be employed for fabricating the components of the clamp described, such as steel, magnesium, aluminum, or others. The use of light metals is particularly preferred, since it makes the clamp easier to carry and handle.

While in accordance with the patent statutes, a preferred embodiment and best mode has been presented, the scope of the invention is not limited thereto, but rather is measured by the scope of the attached claims.

What is claimed is:

1. A rope clamp for resisting slippage of a rope therethrough when the clamp is in its locked mode, while allowing slippage when the clamp is in its unlocked mode comprising: two rope-gripping members; two link plates; two support legs; a base bar, and spring means, wherein a first end of each of said members is pivotally attached to a different end of said link plates, one of said link plates being positioned on each side of said members, said first ends being spaced from each other to provide a space defined by said first ends and by said link plates, adapted to receive a rope therein, the other end of each of said members being pivotally connected to an end of one of said support legs, the other end of each of said legs being pivotally connected to said base bar, and wherein said spring means are positioned between said base bars and one of said link plates so as to urge said one of said link plates from said base bar, pivoting said members and thereby reducing said space at a point of minimum spacing between said first ends and, therefore, increasing the frictional engagement between said first ends and a rope positioned therebetween, placing the clamp in its locked mode, and wherein when said spring means is forced against such urging, said members are also pivoted, whereby said spacing at said point of minimum spacing is maximized, reducing said frictional engagement, and placing the clamp in its unlocked mode.

2. A clamp according to claim 1 wherein said spring means comprises a pin member fastened to said base bar, and slidably fastened to said one of said link plates, said pin member having a spring positioned thereon which urges said one of said link plates from said base bar.

3. A column-climbing device comprising in combination: the rope clamp of claim 1; a user harness, and a rope with an adjustable loop on one end thereof, said harness being attached to said rope clamp, and said rope being positioned between said rope-gripping members.

4. A column-climbing device according to claim 3 wherein both ends of said base bar extend outwardly of the connections with said support legs sufficiently to be grasped by the hands of a climber.

5. A device according to claim 3 wherein said user harness is a sling.

6. A column-climbing device according to claim 5 wherein said sling includes a user seat member in association therewith.

7. A tree-climbing device comprising a rope with an adjustable loop on one end thereof; a rope clamp, and a user harness, said clamp comprising two rope-gripping members, two link plates, two support legs, a base bar, and spring means, a first end of each of said members being pivotally attached to a different end of said link plates, one of said link plates being positioned on each side of said members, said first ends being spaced from each other to provide a space defined by said first ends and said link plates, adapted to receive a rope therein, the other end of each of said members being pivotally connected to an end of one of said support legs, the other end of each of said legs being pivotally connected to said base bar, said spring means being positioned between said base bar and one of said link plates so as to urge said one of said link plates from said base bar, pivoting said members and thereby reducing said space at a point of minimum spacing between said first ends, locking the clamp so as to resist movement of a rope therethrough, and when said one of said link plates is forced against said urging, said rope-gripping members are also pivoted, whereby said spacing at said point of minimum spacing is maximized and the clamp is unlocked, facilitating said movement, wherein said rope is positioned between said first ends of said rope-gripping members, and said user harness is connected to said clamp so that a user of the device wearing said harness can be securely suspended from a tree encircled by said loop when said clamp is locked.

8. A device according to claim 7 wherein said spring means comprises a pin member fastened to said base bar and slidably fastened to said one of said link plates, said pin member having a spring positioned thereon which urges said one of said link plates from said base bar.

* * * * *